United States Patent [19]

Sosa

[11] Patent Number: 4,961,556

[45] Date of Patent: Oct. 9, 1990

[54] PORTABLE DRAFTING TOOLS HANGER

[76] Inventor: Hector M. Sosa, 7311 SW. 132 Ave., Miami, Fla. 33183

[21] Appl. No.: 322,366

[22] Filed: Mar. 13, 1989

[51] Int. Cl.[5] ..... A47F 5/00

[52] U.S. Cl. ..... 248/314; 248/304

[58] Field of Search ..... 248/314, 315, 339, 304, 248/305, 229, 225.31, 309.1, 316.1, 230, 231, 313, 322; 108/26, 27

[56] References Cited

U.S. PATENT DOCUMENTS

| | | | |
|---|---|---|---|
| 3,302,916 | 2/1967 | Kriadis et al. | 248/314 |
| 4,155,310 | 5/1979 | Gregory | 108/26 |
| 4,320,832 | 3/1982 | Edstrom | 248/314 X |
| 4,397,438 | 8/1983 | Chapman | 248/229 |
| 4,431,038 | 2/1984 | Rome | 248/314 X |
| 4,673,148 | 6/1987 | Oliver | 248/315 X |
| 4,696,447 | 9/1987 | Strecker | 248/314 X |
| 4,728,069 | 3/1988 | Semcer | 248/314 X |
| 4,815,683 | 3/1989 | Ferrante | 248/314 X |

*Primary Examiner*—Ramon O. Ramirez

[57] ABSTRACT

A hanger, in combination with a drafting table and more particularly with a cylindrical paper protector attached to said drafting table, for supporting drafting tools and more particularly an electric eraser is described.

Said hanger is formed as a one piece integrally molded device comprising an arcuate portion shaped as a partial cylinder which is generally resilient so it can be installed by snapping it on said paper protector, or inserted onto either end of said paper protector and once installed it can be moved to any location along said paper protector. The hanger also includes a hook-like portion, or a sleeve like portion, or a combination of both, extending from the arcuate portion, providing a surface for receiving and supporting an electric eraser or some other drafting tool.

7 Claims, 1 Drawing Sheet

PORTABLE DRAFTING TOOLS HANGER

This invention relates to drafting tools and is directed particularly to a device to be used for hanging or supporting drafting tools specially an electric eraser from a drafting table.

It is a draftsman necessity to keep his electric eraser hanging by its hanging ring from some kind of a hanger within a reaching distance during the drafting process. The draftsman usually overcomes this problem attaching an eye hook to one end of the lower edge of the drafting table or to the reference table adjacent to it, also especial hangers manufactured for this purpose can be mechanically fastened to the same surfaces. This solution has the disadvantage of producing a permanent damage to the furnitures, especially since many modern offices have reference tables covered with plastic laminate. Another disadvantage of this approach is that the tool remains hanging at the far end of the table being quite uncomfortable to be reaching for it all the time, since the draftsman will be drawing most of the time over different areas of the drafting board, far from where the hanger is.

It is accordingly, the principal object of this invention to provide a novel and improved device for hanging drafting tools and in particular electric erasers, that obviates the deficiencies inherent to the devices heretofore deviced.

A more particular object of the invention resides in the provision of a device comprising a partial cylinder with a longitudinal opening that extends its full length with a width covering about a 90 degree arc of a circle so when the cylinder is seen in cross section it comprises an arc of a circle of about 270 degrees, and includes a member extending outwardly of the outside surface of the cylinder and bending up in an angular shape forming a hook from which an electric eraser can be hung, this member can alternatively be shaped as a loop extending outwardly of the outside surface of the main cylinder which may include an angular shaped member extending outwardly of the exterior surface of the loop member, thus providing a vertical holder through which an electric eraser can be placed and supported and still provides a hanger that can simultaneously support an additional drafting tool, when the device is installed on a spiral tube or cylindrical paper protector previously attached to the lower edge of a drafting table.

Another object of the invention is to provide a device that can be easily installed on a spiral tube or cylindrical paper protector without a special skill nor the need for using any fasteners or tools, by placing it with its longitudinally open surface parallel and against the paper protector, at any point along the length of the paper protector, and applying some pressure until it snaps in place, or by sliding it in place through either end of the paper protector, and that can easily be removed by reversing either process of installation.

Still another object of the invention is to provide a device that once installed, can be moved to any place along the full length of the paper protector, by sliding it to that position.

Other objects features and advantages of the invention will be apparent from the following description, when read with reference to the accompanying drawings. In the drawings, wherein like reference numerals denots corresponding parts throughout the several views.

Figure 1:
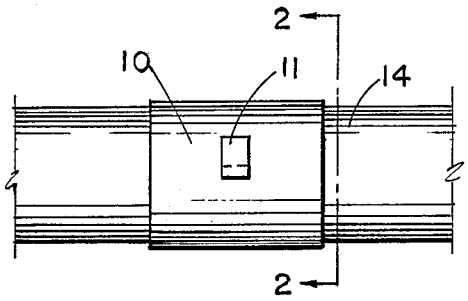
FIG. 1 is a front elevation of the hook version of the device shown in the position related to the vertical plane that it will assume once installed on a paper protector.
Figure 2:
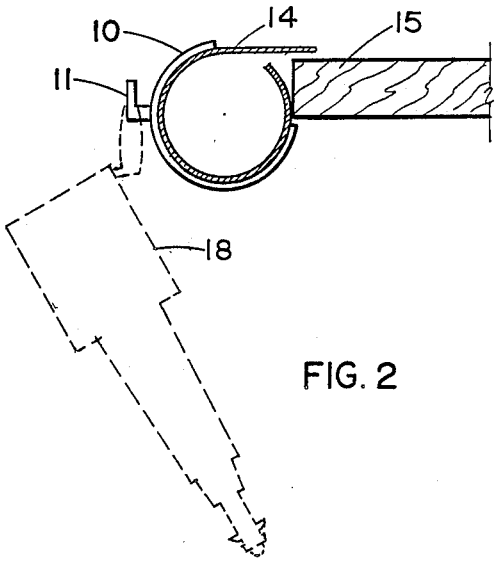
FIG. 2 is a side elevation of the device also shown in the installed position as seen from the vertical plane indicated at FIG. 3 is a perspective view of the device, shown by itself.
Figure 3:
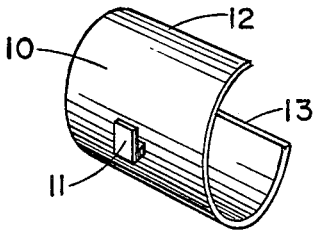
Figure 4:
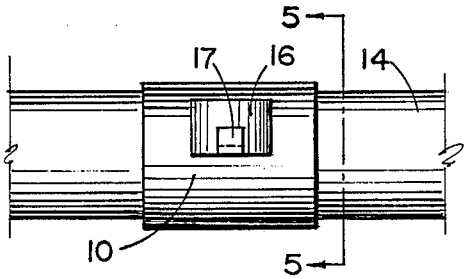
FIG. 4 is a front elevation of an alternate version of the device, that is the combination loop and hook version, shown in the position related to the vertical plane that it will assume once installed on a paper protector.
Figure 5:
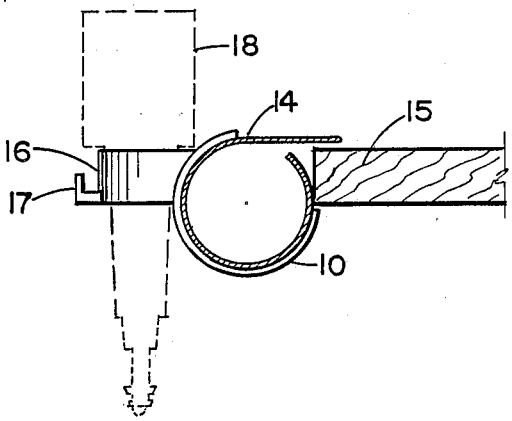
FIG. 5 is a side elevation of the alternate version of the device also shown in the installed position as seen from the vertical plane indicated at 5—5.
Figure 6:
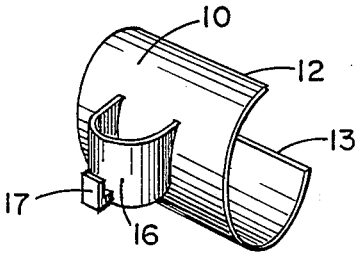
FIG. 6 is a perspective view of the alternate version of the device, shown by itself.

Referring to FIGS. 1–3 of the drawings a hanger 10 is shown therein having an arcuate portion. The hanger is preferably formed of as a generally resilient material in a one piece integrally molded construction. The hanger has an internal diameter which generally correspond to the outside diameter of a cylindrical paper protector 14 secured to a drafting table 15. In this illustrative embodiment an arc defined by ends 12, 13 of the arcuate portions is of about 270 degrees.

A holding means 11 extends outwardly from the periphery of said arcuate portion and defines a means for receiving and holding a drafting tool, i.e. an electric eraser.

A different embodiment is illustrated in FIGS. 3–6. This embodiment shows a hanger identical to the one described before but with a different holding means. The holding means comprises a sleeve like element 16 having a longitudinal axis perpendicular to the longitudinal axis of the hanger. The sleeve has an inside diameter that generally correspond to the elongated portion of an electric eraser. A hook means 17 is attached to the sleeve 16 to receive an additional drafting tool.

In use the hanger 10 is snapped onto the cylindrical paper protector 14 of the drafting table 15, and then is slide along the length of the paper protector to a desired position. A drafting tool, like an electric eraser is then supported by means of the hook 11, or the sleeve 16.

Although an illustrative embodiment of the invention has been shown and described, it is to be understood that various modifications and substitutions may be made by those skilled in the art without departing from the novel spirit and scope of the invention.

What I claim as new and desire to secure by Letters Patent is:

1. A hanger, in combination with a drafting table, particularly holding a cylindrical paper protector attached to an edge for supporting drafting tools and more particularly an electric eraser, which comprises:

(a) a member having an arcuate portion shaped as a partial cylinder, with holding means extending therefrom;

(b) said arcuate portion being C-shaped in cross section and having an inside diameter that generally correspond to the outside diameter of the cylindrical paper protector;

(c) said arcuate portion terminating at a pair of opposed ends which define a space for inserting said hanger onto the cylindrical paper protector; and (d) said holding means extending radially outwardly from the periphery of said arcuate portion, and comprising means for supporting drafting tools and more particularly and electric eraser.

2. A hanger as described in claim 1 wherein said device being formed as o one piece integrally molded device.

3. A hanger as described in claim 1 wherein said arcuate portion comprising a circular arc of about 270 degrees.

4. A hanger as described in claim 1 whereins aid arcuate poriton being generally resileent to enable it to be snapped onto the cylindrical paper protector.

5. A hanger as described in claim 1 wherein said holding means comprises a hook-like member extending radially outwardly from the periphery of said arcuate portion, providing a surface where an electric eraser hanging ring can be hooked on, thus providing support to said electric eraser.

6. A hanger as described in claim 1 wherein holding means comprises:

(a) a sleeve-like member extending radially outwardly from the periphery of said arcuate portion;

(b) said sleeve-like member having a longitudinal axis perpendicular to a longitudinal axis of said arcuate portion;

(c) said sleeve-like member having an inside diameter that generally correspond to the outside diameter of the elongated portion of an electric eraser, to receive said electric eraser and hold it in place.

7. A hanger as described in claim 6 further comprising a hook-like member extending radially outwardly from said sleeve-like member, proving a surface where an additional drafting tool can be hung.

* * * * *